United States Patent [19]

Baggio et al.

[11] Patent Number: 4,916,836

[45] Date of Patent: Apr. 17, 1990

[54] SECURING AND ADJUSTMENT DEVICE PARTICULARLY FOR SKI BOOTS

[75] Inventors: Giorgio Baggio, San Martino Di Lupari; Alessandro Bambace, Castelfranco Veneto, both of Italy

[73] Assignee: Nordica S.P.A., Montebelluna, Italy

[21] Appl. No.: 277,076

[22] Filed: Nov. 28, 1988

[30] Foreign Application Priority Data

Dec. 3, 1987 [IT] Italy ..... 82610 A/87

[51] Int. Cl.[4] ..... A43B 5/04; A43B 7/14

[52] U.S. Cl. ..... 36/119; 36/58.5; 411/535

[58] Field of Search ..... 36/117–121, 36/50; 24/590; 411/535, 536, 538

[56] References Cited

U.S. PATENT DOCUMENTS

| | | | |
|---|---|---|---|
| 4,192,087 | 3/1980 | Salomon | 36/119 |
| 4,193,215 | 3/1980 | Hensler | 36/117 X |
| 4,581,831 | 4/1986 | Kirsch | 36/119 |
| 4,590,691 | 5/1986 | Oliviero | 36/119 |
| 4,712,492 | 12/1987 | Murray | 411/535 X |
| 4,719,670 | 1/1988 | Kurt | 36/119 X |
| 4,823,485 | 4/1989 | Kemmer | 36/119 |

FOREIGN PATENT DOCUMENTS

| | | | |
|---|---|---|---|
| 1806109 | 5/1970 | Fed. Rep. of Germany | 36/120 |
| 322361 | 7/1957 | Switzerland | 411/535 |

*Primary Examiner*—James Kee Chi

*Attorney, Agent, or Firm*—Guido Modiano; Albert Josif

[57] ABSTRACT

The present invention relates to a securing and adjustment device particularly for ski boots comprising a shell containing at least one presser arranged at the foot instep region. The peculiarity of the invention resides in that it comprises an actuation element arranged outside said shell which actuates a central body associated with a first element arranged inside said shell and having at least one inclined-plane surface; a coupling body is associated with the central body and is interconnected with a second element also defining an inclined-plane surface which interacts with the inclined-plane surface of the first element. One of said first and second elements is interconnected with the presser so as to exert a securing action on the foot instep.

12 Claims, 3 Drawing Sheets

SECURING AND ADJUSTMENT DEVICE PARTICULARLY FOR SKI BOOTS

BACKGROUND OF THE INVENTION

The present invention relates to a securing and adjustment device particularly for ski boots.

As is known, ski boots are currently commercially available comprising a device for securing the foot inside the shell, such as for example the device illustrated in the U.S. Pat. No 4192,087 filed February 1978, comprising a presser constituted by two shell-shaped elements which laterally embrace the foot and can be tightened against one another by means of a screw which interacts therewith, said screw possibly having an eccentric element, said stem of said screw having opposite threads.

The disadvantage observable in this kind of known solution resides in the fact that it is constructively very complicated and in that the adjustment is substantially performed by acting on the screw, since the eccentricity, if any, must be low for reasons of lateral bulk.

It has been furthermore observed that acting on the sides of the foot causes discomfort or fatigue since the lateral bones of the foot are compressed.

As a consequence of this, the sole of the foot can remain raised due to the arching of the foot, consequently causing loss of sensitivity on the skis.

U.S. Pat. No. 4,193,215 filed on July 10, 1978, discloses an eccentric lever which rotates a pivot which is rigidly coupled with a presser overlying the foot.

This solution, too, has disadvantages, since the opening of the lever allows the pivot a limited stroke and therefore an insufficient release of the foot and it is furthermore necessary to rotate said lever to complete both the release and the securing.

U.S. Pat. No. 4,581,831 filed on 12.6.1983 discloses a ski boot internally having a presser pivoted at one end at the tip region, interacting with a pivot the position whereof can be changed by means of a lever or a screw.

This invention, too, has disadvantages, among which a nil or very difficult adjustment of the securing degree the solution being furthermore rather complicated and bulky.

In order to simplify the operation of the presser arranged at the foot instep, the Italian patent application No. 20828 B/84, filed on 12.10.1984 in the name of NORDICA S.p.A., discloses an actuation device comprising a shaped pin extending from a foot instep presser arrangeable inside the shell; a threaded pivot couples snap-together with said pin and rotatably engages the inner thread of a bush rotatably supported by the shell.

An actuation knob is furthermore provided and is associable snap-together with the bush and can be accessed from the outside of the boot.

Though both the actuation and the assembly of the device are simplified, it is nonetheless not possible to rapidly release the foot for example during short stops at ski-lifts.

Italian patent No. 196589 filed on 4.10.1984 discloses a foot presser device comprising a control lever and a cam which actuates a tappet slidable inside a hollow screw which can be screwed to a female thread fixed to the boot.

Said tappet interacts with a coaxial spring which pushes a point connected to an underlying presser.

This device however has the disadvantage of comprising a large number of components and is furthermore scarcely compact and not immediately actuatable.

According to the degree of securing, the screw and the lever furthermore vary their height with respect to the plane of the boot, this being unsatisfactory both aesthetically and functionally.

Italian patent application No. 41619 A/84 filed on 8.9.1984 discloses a device comprising a presser body having a rocker element interacting with teeth, said presser body acting on a partition arranged above the foot instep.

The adjustment of the compression of the foot instep performed by this device, however, requires a considerable effort on the part of the user, as he has to press directly at the rocker element.

SUMMARY OF THE INVENTION

The aim proposed by the invention is indeed to eliminate the previously described disadvantages by providing a device which allows to optimally secure and adjust the foot at the instep region by means of extremely rapid and easy operations executable from the outside of the boot.

Within the scope of the above described aim, a particular object of the invention is to provide a device which associates with the preceding characteristic that of having very low costs and of subjecting the foot to an anatomically correct securing, allowing at the same time the optimum transmission of efforts to the ski.

A further object of the invention is to provide a device which combines rapid securing and release with an optimum aesthetic appearance and a very low bulk.

Not least object of the present invention is to provide a device which is easily obtainable starting from elements and materials commonly commercially available and is furthermore advantageous from a merely economical point of view.

The above described aim, as well as the mentioned objects and others which will become apparent hereinafter, are achieved by a securing and adjustment device for ski boots in general, particularly for ski boots comprising a shell containing at least one presser arranged at a pressing region in general such as the foot instep region, characterized in that it comprises an actuation element arranged outside said shell and actuating a central body associated with a first element arranged inside said shell and having at least one inclined-plane surface, a coupling body being associated with said central body, said coupling body being axially movable with respect to said central body and interconnected with a second element defining at least one inclined-plane surface interacting with said first element, at least one of said first and second elements being interconnected with said presser.

BRIEF DESCRIPTION OF THE DRAWINGS

Further characteristics and advantages will become apparent from the description of some preferred but not exclusive embodiments, illustrated only by way of non-limitative example in the accompanying drawings, wherein.

DESCRIPTION OF THE PREFERRED EMBODIMENTS

Figure 1:
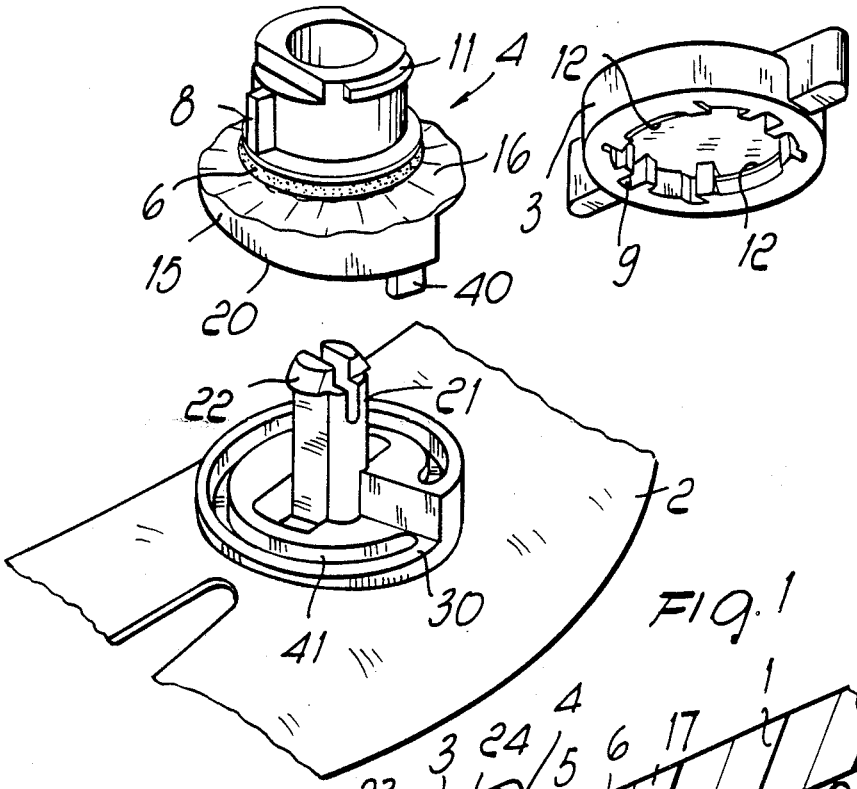
FIG. 1 is a schematic exploded isometric view of a device according to the invention.
Figure 2:
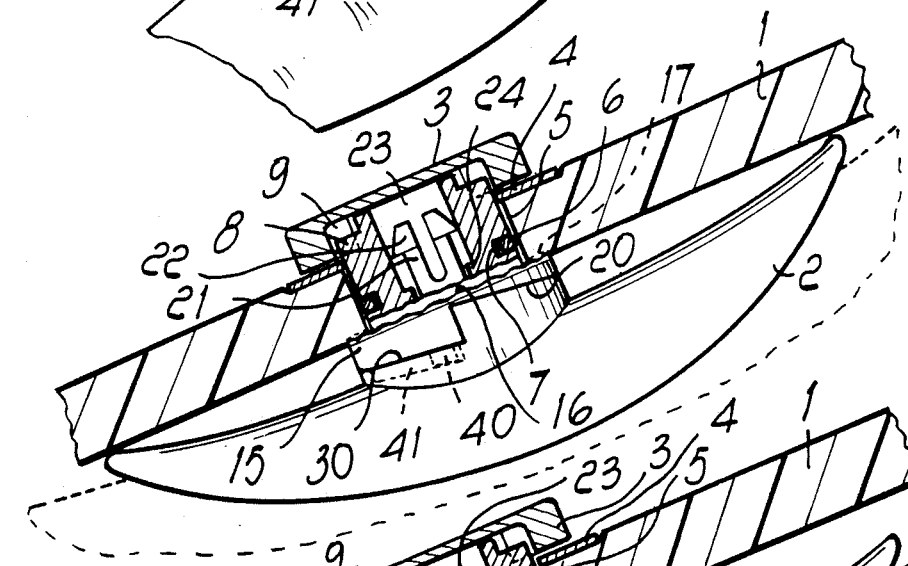
FIG. 2 is a sectional view of the device of FIG. 1 schematically applied to a ski boot with the presser arranged in raised position.
Figure 3:
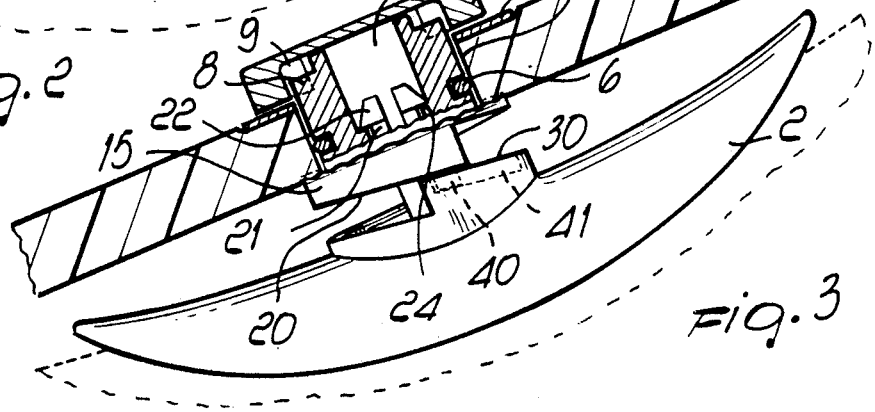
FIG. 3 is a sectional view of the device with the presser arranged in lowered position, i.e. in the position in which the maximum securing action is exerted on the foot.

With reference to the above described figures, and in particular with reference to FIGS. 1 to 3, the securing and adjustment device particularly for ski boots, according to the invention, is applicable at the shell 1 in the front region of the foot instep, where a substantially rigid foot instep presser, generally indicated by the reference numeral 2, is arranged.

The illustrated embodiment comprises an actuation element arranged outside the shell 1 and provided by means of a flattened knob 3 which rigidly couples in rotation with a central body constituted by a bush generally indicated by the reference numeral 4.

More in detail, the bush 4 is rotatably supported in a hole 5 defined on the shell 1; sealing means constituted by an annular gasket 6 are accommodated in a recess 7 of the outer surface of the bush 4.

The bush 4 is upwardly provided with radial teeth 8 which engage in recesses 9 of the flattened knob 3 to rigidly couple it in rotation, and edge teeth 11 furthermore insert snap-together in undercuts 12 defined by the knob 3.

The bush 4 has a flanged portion 15 inside the boot, having, on the surface directed towards the inside of the shell 1, a set of coupling teeth constituted by undulated teeth 16 engaging with corresponding undulations 17 defined on the inner surface of the shell to act as element for angularly positioning said bush with respect to the shell.

On its lower face, the flange 15 defines a first element with an inclined-plane surface, constituted in particular by a helical inclined surface 20.

Inside the bush 4, which constitutes the central body, there is a coupling body constituted by a stem 21 upwardly provided with coupling teeth 22 which insert in the axial cavity 23 of the bush 4 and engage with stop edges 24 defined at the lower axial end to prevent the accidental extraction of the stem 21 from the cavity 23.

In the described embodiment, the stem 21 is advantageously rigidly associated with the presser 2 and is arranged coaxially to a second inclined-surface element constituted by a second helical surface 30 shaped complementarily to the first helical surface 20.

A stop and guiding tab 40 axially extends from the end of the first helical surface 20 and inserts in a recess 41 correspondingly provided inside the second helical surface 30 so as to act as rotation guiding element and as stop element when the surfaces are arranged so as to exert the maximum pressure on the presser 2, as schematically indicated in FIG. 3.

In practical use, by turning the flattened knob 3 the conditions of the coupling between the helical surfaces 20 and 30 are changed, obtaining in practice a translatory motion of the presser in a direction substantially perpendicular to its point of application on the shell.

The translatory action is obtained with extremely simple and rapid movements since the transmission of the motion occurs directly simply by virtue of the coupling between the inclined surfaces.

The presence of the undulated set of teeth 16, which engages with the complementary undulated set of teeth 17 defined on the shell 1, allows to simply and rapidly adjust the securing action exerted on the presser.

Figure 4:
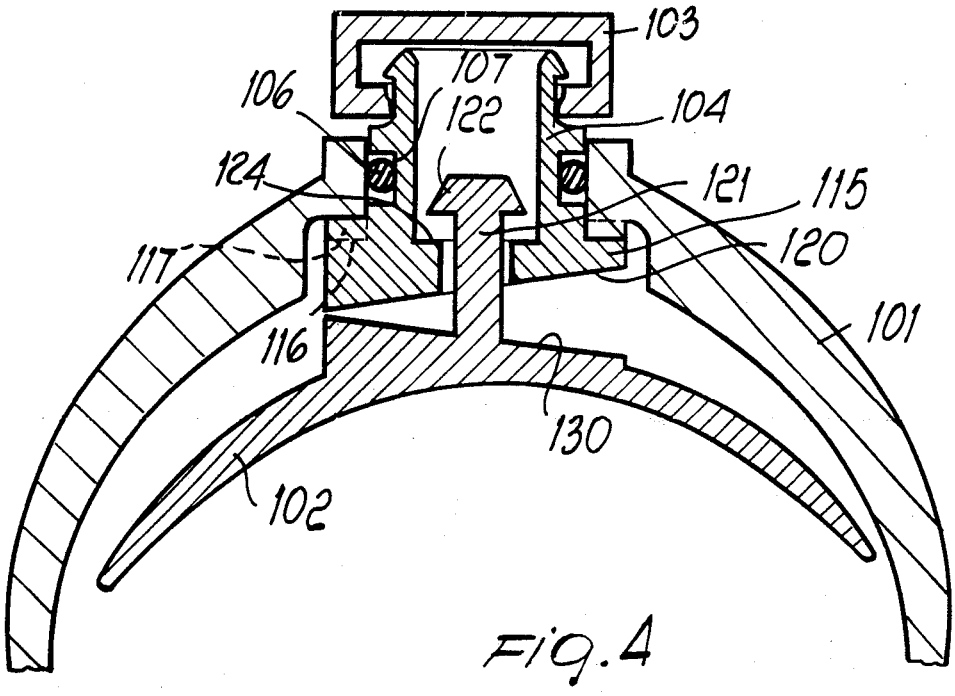
FIG. 4 is a schematic isometric view of a device according to a second aspect of the invention illustrated with the presser in lowered position.
Figure 5:
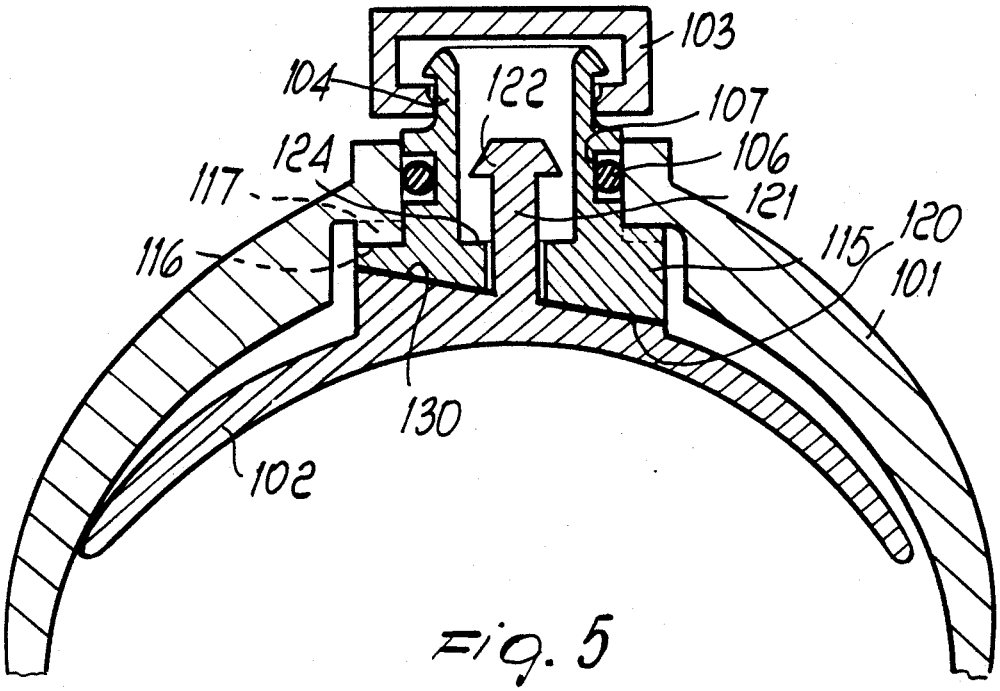
FIG. 5 is a view of the device of FIG. 4 with the presser in raised position.

FIGS. 4 and 5 illustrate a different embodiment of the device, comprising an actuation element constituted by a knob 103 keyed at the lateral surface of a bush 104.

The bush is internally hollow and has a radial groove 107 for accommodating a sealing gasket 106 interposed between the bush and the shell, which is now indicated by 101.

The shell has, on its inner surface, a complementarily toothed region 117 which couples with a toothed region 116 defined by the flange 115 of the bush 104.

A mushroom 121 with an expanded head 122 is slidably accommodated inside the bush 104 and is engageable with a lower stop abutment 124.

The bush has, at its inner end, a first inclined-plane surface 120 which interacts with a second inclined-plane surface 130 associated with the presser, which is now indicated by 102.

In this case, too, a rotation imparted to the knob produces an axial movement of the presser along a direction which substantially coincides with the axis of said bush, by virtue of the interaction of the surface 120 with the surface 130.

Figure 6:
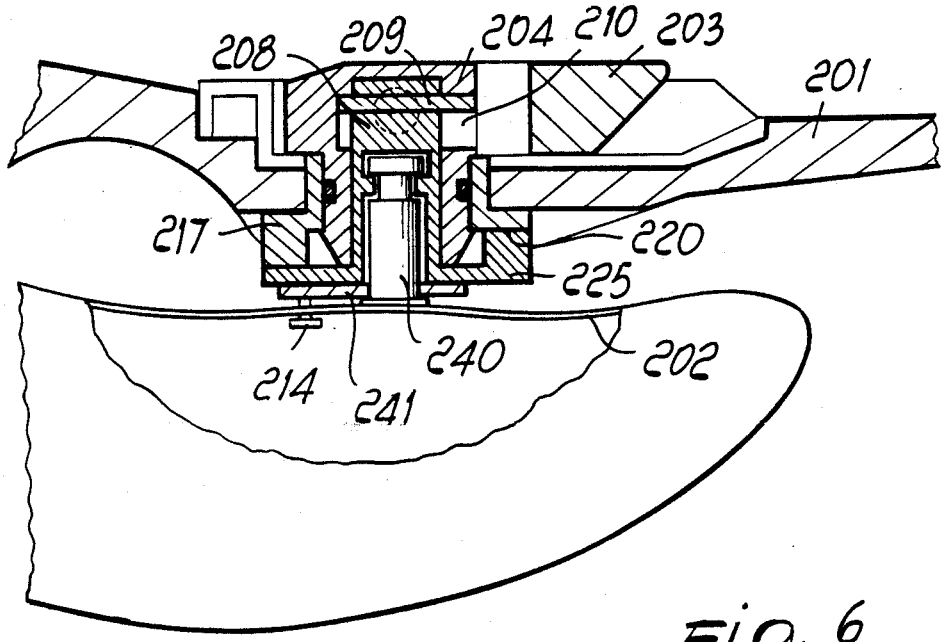
FIG. 6 is a schematic sectional view of the device provided with a lever-like actuation element, with the presser in raised position.
Figure 7:
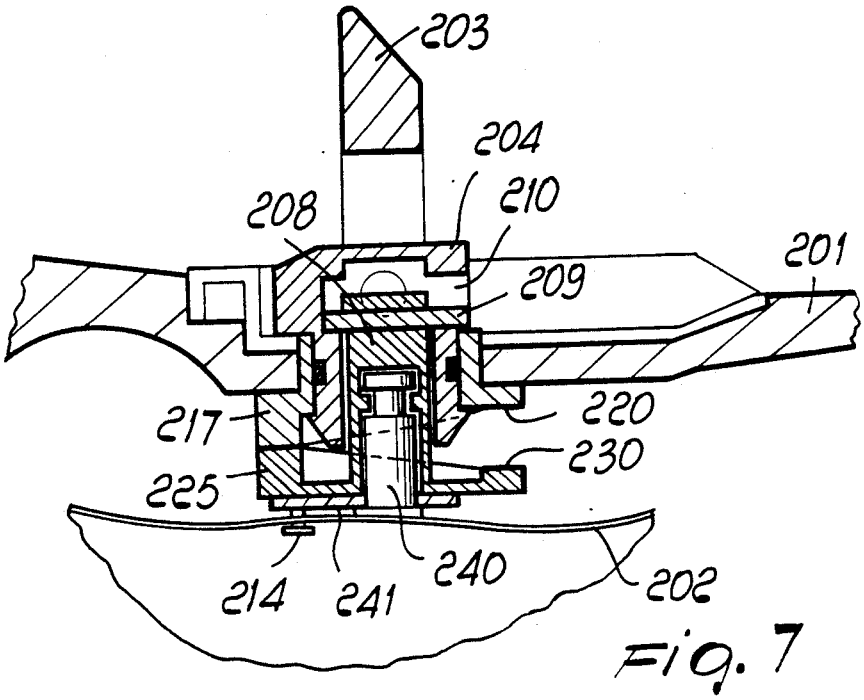
FIG. 7 is a view of the device of FIG. 6 with the presser in lowered position.

With reference to FIGS. 6 and 7, a further embodiment is illustrated wherein the actuation element is constituted by a U-shaped lever 203 freely pivoted at the wings of the central body 204, having a substantially cylindrical and particularly hollow configuration.

A first element 217 defining a first inclined-plane surface 220 is externally and coaxially associated with the central body 204.

The first element 217 can also be provided monolithically with the shell.

A cylindrical stem 208 is slidable inside the central body 204 and has, at its end directed towards the lever 203, a stop element 209 arranged diametrically to said lever and protruding therefrom.

Said stop element slides within an adapted slot 210 provided at the central body 204.

A second element 225 defining a second inclined-plane surface 230 is associated at the opposite end of the cylindrical stem 208.

The second surface 230 is arranged facing the first surface 220.

The outer lateral surface of said first element is advantageously in contact with the shell.

An connection element for interconnecting with the presser, which is now indicated by 202, is coaxially associated with the partially hollow stem 208 and is constituted by a cylindrical pivot 240 having an end which protrudes externally to said stem and is connected to the presser 202 by means of rivets 214 interposed between the presser and a plate 241 rigidly associated with said pivot.

In practical use, once the lever has been raised and turned, the second element 225 is rotated, its surface 230 imposing, by interacting with the first inclined surface 220 of the first element 217, a rapid axial translatory motion to the cylindrical stem 208 and consequently to the presser.

As illustrated in FIG. 7, it is sufficient to impart a 180° rotation to the lever to obtain the maximum movement of the presser.

From the above it is apparent that the invention achieves the intended aims and objects and in particular the fact is stressed that a securing device is provided which allows a rapid and easy adjustment of the pressure exertable at the presser, requiring a limited number of actuations and also allowing to obtain the required securing degree.

The invention thus conceived is susceptible to numerous modifications and variations, all of which are within the scope of the inventive concept.

Furthermore, all the details may be replaced with other technically equivalent elements.

In practice, the materials employed, as well as the contingent shapes and dimensions, may be any according to the requirements.

We claim:

1. In combination, a ski boot and a securing and adjusting device, said ski boot comprising;

a shell, a foot pressing region inside said shell, said shell having a through hole at said foot pressing region, said securing and adjusting device comprising;

a central bush-like body extending into said through hole and having a longitudinal axis substantially coaxial therewith, a first body portion element associated with said central bush-like body and arranged inside said shell and having at least one first substantially inclined-plane surface transverse to said longitudinal axis, a coupling body being axially movable with respect to said central bush-like body.

a second body portion element associated with said coupling body and arranged inside said shell and having at least one second substantially inclined-plane surface facing said first inclined-plane surface for interacting therewith, said first and said second body portion elements forming a pair of cooperating body portion elements, an external actuation element arranged outside said shell for actuating one of said body portion elements thereby to cause a relative sliding movement between said first and said second substantially inclined-plane surfaces, at least one presser arranged at said foot pressing region and cooperating with said second body portion element.

2. Device according to claim 1, wherein said central bush-like body has an axial recess and is rotatably supported by said shell and having means for coupling with said external actuation element, wherein said first substantially inclined-plane surface is a first helical inclined-plane surface, wherein said coupling body is constituted by a stem rigidly attached with said presser and slidably accommodatable in said recess defined by said central bush-like body, wherein said second substantially inclined-plane surface is a second helical inclined-plane surface, said second body portion element being connected with said stem, whereby rotatory actuation of said external actuation element causes a relative sliding movement between said first helical inclined-plane surface and said second helical inclined-plane surface producing a relative axial movement thereof and a movement of said presser in a direction which substantially coincides with the axis of said central bush-like body.

3. Device according to claim 1, comprising stop and guiding means interacting between said first body portion element and said second body portion element.

4. Device according to claim 3, wherein said stop and guiding means are constituted by a tab extending axially from one of said body portion elements, slidably engaging with a recess correspondingly defined on the other of said body portion elements.

5. Device according to claim 1, further comprising a sealing element, wherein said central bush-like body is internally partially hollow and is externally provided with a circumferential groove acting as a seat for said sealing element, said sealing element constituted by an elastically deformable ring interposed between said central bush-like body and said shell.

6. Device according to claim 1, wherein said actuation element is constituted by a knob keyed at a lateral surface of said central bush-like body.

7. Device according to claim 2, comprising , on said central bush-like body, means for controlling angular position of said central bush-like body with respect to said shell.

8. Device according to claim 7, wherein said means are constituted by a set of undulated teeth defined on said first body portion element and a corresponding complementary set of teeth defined on the inner surface of said shell.

9. Device according to claim 1, wherein said central bush-like body is partially hollow to define an axial recess therein and is supported by said shell, wherein said first inclined-plane surface is a first helical inclined-plane surface and said first body portion element thereof is rigid with said shell, wherein said coupling body is constituted by a partially hollow cylindrical stem slidably accommodatable in said recess defined by said central bush-like body, wherein said second substantially inclined-plane surface is a second helical inclined-plane surface connected with said stem, the device further comprising means of interconnection of said stem with said presser, wherein rotatory actuation of said external actuation element causes a relative sliding movement between said first helical inclined-planed surface and said second helical inclined-plane surface producing an axial movement of said presser in a direction which substantially coincides with the axis of said central bush-like body.

10. Device according to claim 9, wherein said external actuation element is constituted by a U-shaped lever with its wings pivoted to said bush, wherein said stem has a stop element freely slidable in a longitudinal slot provided in said bush.

11. Device according to claim 9, wherein said means of interconnection comprise a cylindrical pivot inserted into said stem, a plate rigidly associated with said pivot and connected to said presser by means of a set of rivets interposed between said presser and said plate.

12. A securing and adjustment device particularly for ski boots of the type comprising a shell containing at least one presser, at least one of said pressers being arranged at a foot instep region of said ski boot, said securing and adjustment device comprising:

a central bush-like body having a longitudinal axis, a first body portion element associated with said central bush-like body for arrangement inside said shell and having at least one first substantially inclined-plane surface transverse to said longitudinal axis, a coupling body being axially movable with respect to said central bush-like body, a second body portion element associated with said coupling body for arrangement inside said shell and having at least one second substantially inclined-plane surface facing said first inclined-plane surface for interacting therewith, said first and said second body portion elements forming a pair of cooperating body portion elements, an external actuation element for arrangement outside said shell for actuating one of said body portion elements thereby to cause a relative sliding movement between said first and said second substantially inclined-plane surfaces, and means for connecting said second body portion element with said presser.

* * * * *